US008033856B2

(12) United States Patent
Mito et al.

(10) Patent No.: US 8,033,856 B2
(45) Date of Patent: Oct. 11, 2011

(54) ELECTRICAL CONNECTOR ASSEMBLY

(75) Inventors: Yusuke Mito, Tokyo (JP); Hiroshi Kobayashi, Aichi-ken (JP); Kunihiro Sugihara, Aichi-ken (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 618 days.

(21) Appl. No.: 12/279,615

(22) PCT Filed: Feb. 14, 2007

(86) PCT No.: PCT/JP2007/052605

§ 371 (c)(1),
(2), (4) Date: Aug. 15, 2008

(87) PCT Pub. No.: WO2007/094356

PCT Pub. Date: Aug. 23, 2007

(65) Prior Publication Data

US 2011/0143569 A1 Jun. 16, 2011

(30) Foreign Application Priority Data

Feb. 17, 2006 (JP) ..... 2006-041506

(51) Int. Cl.
*H01R 13/62* (2006.01)

(52) U.S. Cl. ..... 439/358

(58) Field of Classification Search ..... 439/358, 439/357

See application file for complete search history.

(56) References Cited

U.S. PATENT DOCUMENTS

| | | | | |
|---|---|---|---|---|
| 5,378,168 | A * | 1/1995 | Sumida | 439/358 |
| 5,664,961 | A * | 9/1997 | Tsuji et al. | 439/358 |
| 5,775,932 | A | 7/1998 | Saito et al. | |
| 5,913,703 | A | 6/1999 | Suzuki et al. | |
| 6,053,766 | A * | 4/2000 | Muramatsu et al. | 439/558 |
| 6,217,365 | B1 * | 4/2001 | Shinozaki | 439/358 |
| 6,485,315 | B1 * | 11/2002 | Hwang | 439/108 |
| 6,648,669 | B1 * | 11/2003 | Kim et al. | 439/357 |
| 7,285,004 | B1 * | 10/2007 | Fukuda et al. | 439/358 |
| 7,407,403 | B2 * | 8/2008 | Tanaka et al. | 439/358 |

FOREIGN PATENT DOCUMENTS

| | | |
|---|---|---|
| JP | 02-24482 | 2/1990 |
| JP | 04-206483 | 7/1992 |
| JP | 04-206486 | 7/1992 |
| JP | 09-017497 | 1/1997 |
| JP | 09-115607 | 5/1997 |
| JP | 09-306582 | 11/1997 |

* cited by examiner

*Primary Examiner* — Gary F. Paumen
(74) *Attorney, Agent, or Firm* — Barley Snyder

(57) ABSTRACT

An electrical connector assembly which has a plurality of male connectors and a female connector that mates with the plurality of male connectors. Each of the male connectors has a male-type housing and a female-type contact secured to this male-type housing. Each of the male-type housings has a lock arm that is provided on the upper surface or undersurface of the male-type housing with the free end of this lock arm being positioned at the rear end of the housing. A lock arm protection member that protrudes upward or downward from the rear end of the upper surface or undersurface of the male-type housing and protects the lock arm. The female connector has a female-type housing and a male-type contact secured to this female-type housing. The female-type housing has a plurality of male connector receiving parts that receive the male-type housings and lock members on which the lock arms respectively latch. The walls between adjacent male connector receiving parts in the female-type housing are such that the front ends thereof are positioned further toward the interior than the mating surface of the female-type housing. A recessed part that receives the lock arm protection member of each of the male connectors is formed in the mating surface in the upper wall or lower wall of each of the male connector receiving parts.

4 Claims, 6 Drawing Sheets

Prior Art

ELECTRICAL CONNECTOR ASSEMBLY

FIELD OF THE INVENTION

The present invention relates to an electrical connector assembly comprising a plurality of male connectors and a female connector having a plurality of male connector receiving parts that receive the plurality of male connectors.

BACKGROUND

In the electrical connection between an automotive ECU or the like and respective electrical wires (of a wire harness) on the side of the vehicle body, for example, the plurality of electrical wires have been connected at one time in the past using a comprehensive connection-type male connector on the side of the vehicle body and a female connector that mates with this male connector on the side of the ECU or the like.

However, in methods in which this comprehensive connection-type male connector is used, a large amount of mating force is required during the mating with the female connector, so that a connector comprising a lever-type force multiplying device is used to reduce the force required for the mating work.

Here, a connector for connecting numerous electrical wires to an ECU or the like has generally been required to satisfy several technical objectives such as: (a) reducing the operating force during insertion and removal; (b) reducing the size; and (c) ensuring the degree of freedom in the arrangement and distribution.

In the above-mentioned methods that use a connector comprising a lever-type force multiplying device described above, there are problems in that a size reduction is difficult, and in that the degree of freedom in the arrangement is small because space is required for the operation of the lever. Therefore, methods that use a connector comprising a lever-type force multiplying device have not been adopted much in recent years.

Accordingly, in recent years, in order to further reduce the mating force during mating with a female connector, instead of using a comprehensive connection-type male connector or lever-type connector, a connector is often divided into a plurality of male connectors. Specifically, the use of an electrical connector assembly comprising a plurality of male connectors and a female connector having a plurality of male connector receiving parts has become a common practice in the electrical connection between an automotive ECU or the like and respective electrical wires on the side of the vehicle body, so that a plurality of male connectors are caused to mate with a single female connector.

Here, a measure is taken to avoid buckling of and damage to male-type contacts provided on the female connector by preventing twisting of the male-type contacts when a male connector is caused to mate in an inclined state during the mating of each male connector with the female connector.

In order to prevent such twisting of the male-type contacts provided on the female connector, the mating depth has been generally increased in the past by lengthening the hood portions of the male connector receiving parts formed in the female connector while also lengthening the housings of the male connectors that mate with the female connector.

However, lengthening the housings of the male connectors that mate with the female connector has created the following problem: namely, when retainers are respectively inserted in the male connectors, the semi-mounted state of the female-type contacts provided on the male connectors cannot be detected. Furthermore, increasing the length of the hood portions of the male connector receiving parts formed in the female connector goes against the requirement of a reduction in size.

Moreover, on the side of the female connector having the plurality of male connector receiving parts, the following problem has been encountered: namely, lengthening the hood portions of the male connector receiving parts also lengthens the walls between adjacent male connector receiving parts that are made thinner as the number of poles increases, and these walls break as a result of twisted mating of the male connectors (when the male connectors are caused to mate with the female connector in an inclined state). In forming the plurality of male connector receiving parts on the female connector side, the mating opening must be divided into a plurality of parts. However, it is not acceptable to expand the entire width of the female connector because of the size reduction requirement, so that it is inevitable to reduce the width of the walls between adjacent male connector receiving parts.

Therefore, it is desirable that the mating depth be reduced by reducing the length of the hood portions of the male connector receiving parts formed in the female connector while also reducing the length of the housings of the male connectors that mate with the female connector.

Furthermore, in automotive connectors, it is necessary to provide a lock arm on the side of a male connector in order to interlock the male connector and female connector, and it is also necessary to provide a lock arm protection member on the side of the male connector in order to prevent the lock arm from being damaged by an abrupt external force caused by electrical wires catching the rear end of the lock arm during the assembly work of the male connector, storage or transport of a wire harness, or the like.

Meanwhile, the electrical connector shown in FIG. 7 (see JP-A-09-115607), for example, has been known in the past as an electrical connector in which a pair of male and female connectors mate while preventing the twisting of the male-type contacts. FIG. 7 is a perspective view showing an electrical connector prior to the mating of a pair of male and female connectors.

The electrical connector 101 shown in FIG. 7 comprising a male connector 110 and a female connector 120 that mates with the male connector 110.

The male connector 110 comprises a substantially rectangular male-type housing 111 and a plurality of female-type contacts (not shown in the figure) secured to the male-type housing 111. Furthermore, a cantilever-form lock arm 112 that extends rearward from the front end is provided on the upper wall of the male-type housing 111. Meanwhile, the female connector 120 comprises a female-type housing 121 having a male connector receiving part 122 that receives the male connector 110, and a plurality of male-type contacts 124 that are secured to the female-type housing 121 and that are received by and make contact with the plurality of female-type contacts. Moreover, a twisting-prevention member 123 protrudes inside the male connector receiving part 122 of the female connector 120, while an escape part 113 that permits the entry of the twisting-prevention member 123 is formed in the front end surface of the lock arm 112 of the male connector 110 facing the female connector 120.

In addition, when the male connector 110 is caused to mate with the female connector 120 in an inclined state, the front end surface or one of the side surfaces of the male-type housing 111 of the male connector 110 contacts the twisting-prevention member 123 provided on the female connector 120, and this prevents the twisting of the male-type contacts 124 inside the female connector 120, so that buckling of and damage to the male-type contacts 124 are avoided.

In the electrical connector 101 shown in FIG. 7, furthermore, a pair of lock arm protection members 114 that protect the lock arm 112 by protruding upward are provided at the rear end of the upper surface of the male-type housing 111 of the male connector 110. By providing these lock arm protection members 114, it is possible to prevent the lock arm 112 from being damaged by an abrupt external force caused by electrical wires (not shown in the figure) catching the rear end of the lock arm 112 during the assembly work of the male connector 110, storage or transport of a wire harness, or the like.

However, if the mating depth is reduced by reducing the length of the hood portions of the male connector receiving parts formed in the female connector while also reducing the length of the housings of the male connectors that mate with the female connector, then the twisting of the male-type contacts provided on the female connector cannot be prevented properly. Furthermore, even if the mating depth of both connectors is reduced, on the side of the female connector having the plurality of male connector receiving parts, the problem remains in that the breaking of the walls between adjacent male connector receiving parts caused by the twisted mating of the male connectors cannot be avoided in some cases.

Meanwhile, in the case of the electrical connector 101 shown in FIG. 7, although it is possible to properly protect the lock arm 112 and to prevent the twisting of the male-type contacts 124 inside the female connector 120, it is necessary to provide the twisting-prevention member 123 on the side of the female connector 120 and to form the escape part 113 on the side of the male connector 110. Therefore, the problem is that the construction of the electrical connector 101 becomes complicated.

SUMMARY

Accordingly, the present invention was devised to solve the problems described above. It is an object of the present invention to provide an electrical connector assembly having a plurality of male connectors each having a lock arm and a lock arm protection member, and a female connector having a plurality of male connector receiving parts. This electrical connector assembly has a simple construction, and there is no risk of damaging the male-type contacts and walls between adjacent male connector receiving parts in the female connector caused by twisted mating of the male connectors even if the mating depth is made smaller than in conventional products.

In order to solve the problems described above, the electrical connector assembly of the present invention is an electrical connector assembly which has a plurality of male connectors and a female connector that mates with the plurality of male connectors. Each of the male connectors has a male-type housing and a female-type contact secured to this male-type housing. Each of the male-type housings has a lock arm that is provided on the upper surface or undersurface of the male-type housing with the free end of this lock arm being positioned at the rear end of the housing. A lock arm protection member that protrudes upward or downward from the rear end of the upper surface or undersurface of the male-type housing and protects the lock arm. The female connector has a female-type housing and a male-type contact secured to this female-type housing. The female-type housing has a plurality of male connector receiving parts that receive the male-type housings and lock members on which the lock arms respectively latch. The walls between adjacent male connector receiving parts in the female-type housing are such that the front ends thereof are positioned further toward the interior than the mating surface of the female-type housing. A recessed part that receives the lock arm protection member of each of the male connectors is formed in the mating surface in the upper wall or lower wall of each of the male connector receiving parts.

In the electrical connector assembly of the present invention, the walls between adjacent male connector receiving parts in the female-type housing of the female connector are such that the front ends thereof are positioned further toward the interior than the mating surface of the female-type housing. Consequently, the walls between adjacent male connector receiving parts become shorter, so that even if the mating depth is made smaller than in conventional products in an electrical connector assembly having a plurality of male connectors and a female connector, it is possible to avoid the risk of damaging the walls between adjacent male connector receiving parts caused by twisted mating of the male connectors. Furthermore, a recessed part that receives the lock arm protection member of each male connector is formed in the mating surface in the upper wall or lower wall of each of the male connector receiving parts out of the mating surface of the female-type housing. Therefore, the tip end positions of the male-type contacts can be retracted by the length for receiving the lock arm protection members. Thus, even if the mating depth is made smaller than in conventional products in an electrical connector assembly consisting of a plurality of male connectors each having a lock arm and a lock arm protection member, and a female connector having a plurality of male connector receiving parts, it is possible to provide an electrical connector assembly with a simple construction without any risk of damaging the male-type contacts of the female connector caused by twisted mating of the male connectors. Moreover, because the mating depth can be made smaller than in conventional products, it is possible to achieve a size reduction of an electrical connector assembly.

DETAILED DESCRIPTION OF AN EMBODIMENT OF THE INVENTION

Figure 1:
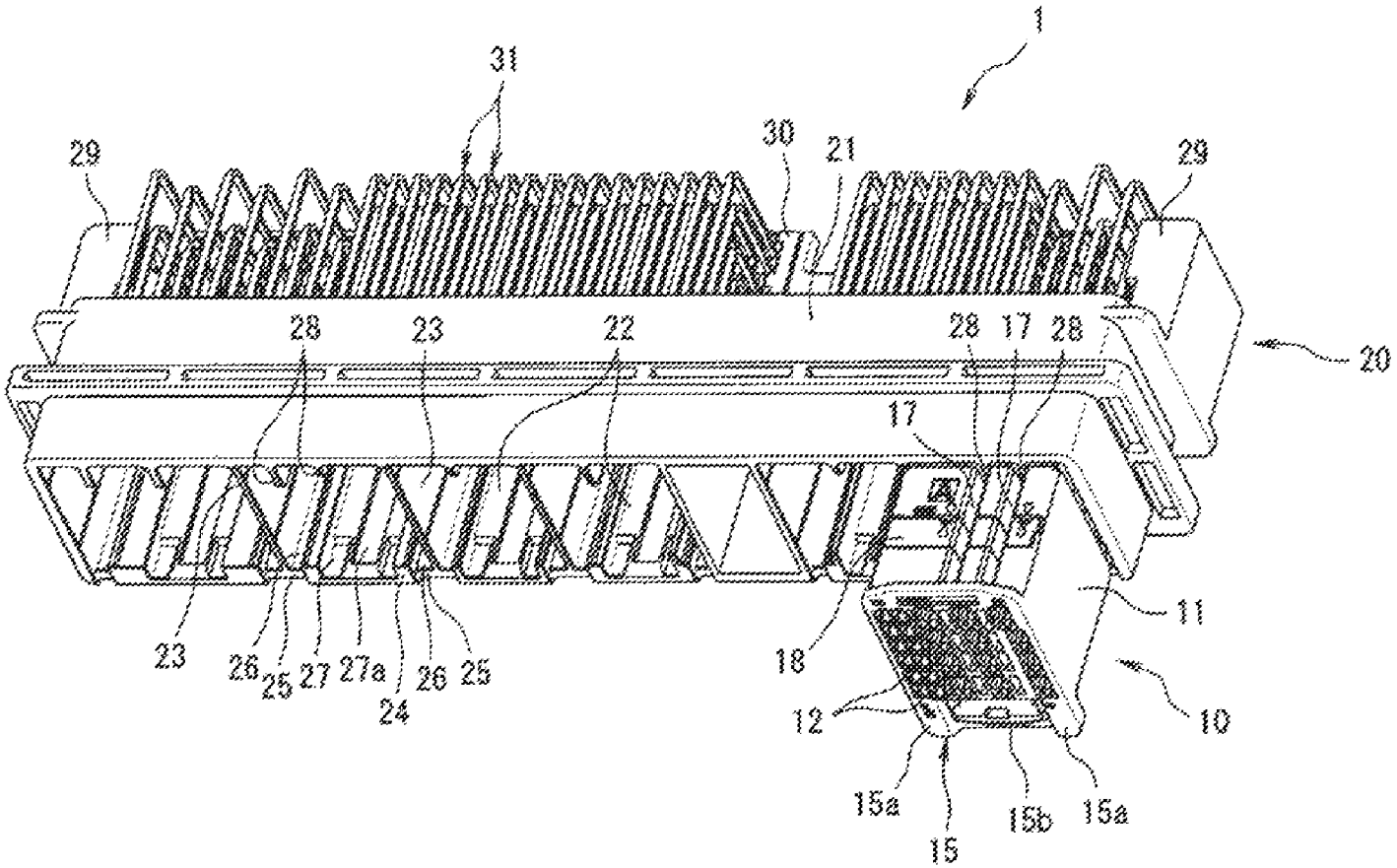
FIG. 1 is a perspective view of an electrical connector assembly of the present invention; here, only one male connector out of a plurality of male connectors that are caused to mate with a female connector is shown in FIG. 1.
Figure 2:
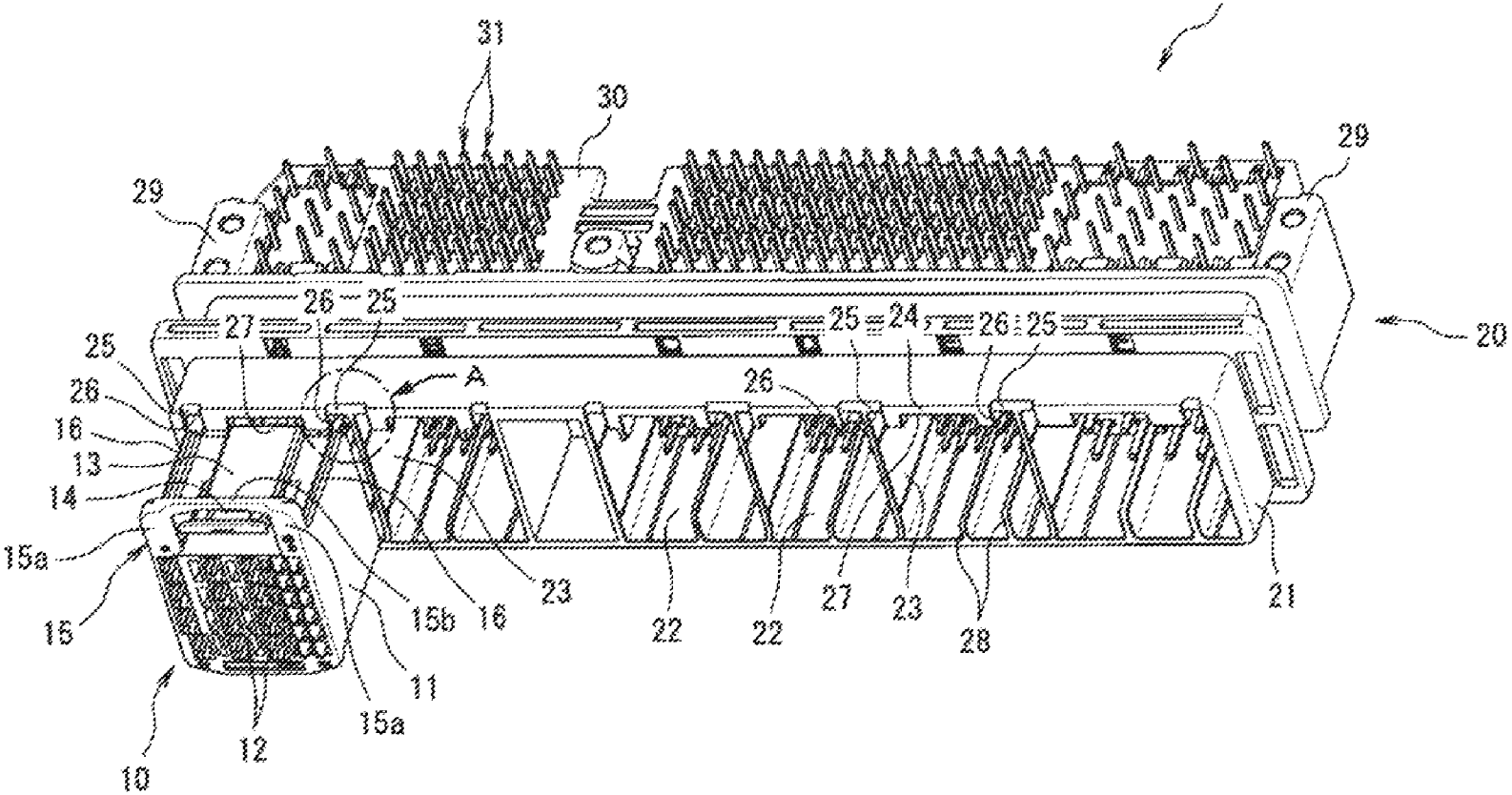
FIG. 2 is a perspective view of the electrical connector assembly of FIG. 1 as seen from the side of the undersurface.
Figure 3:
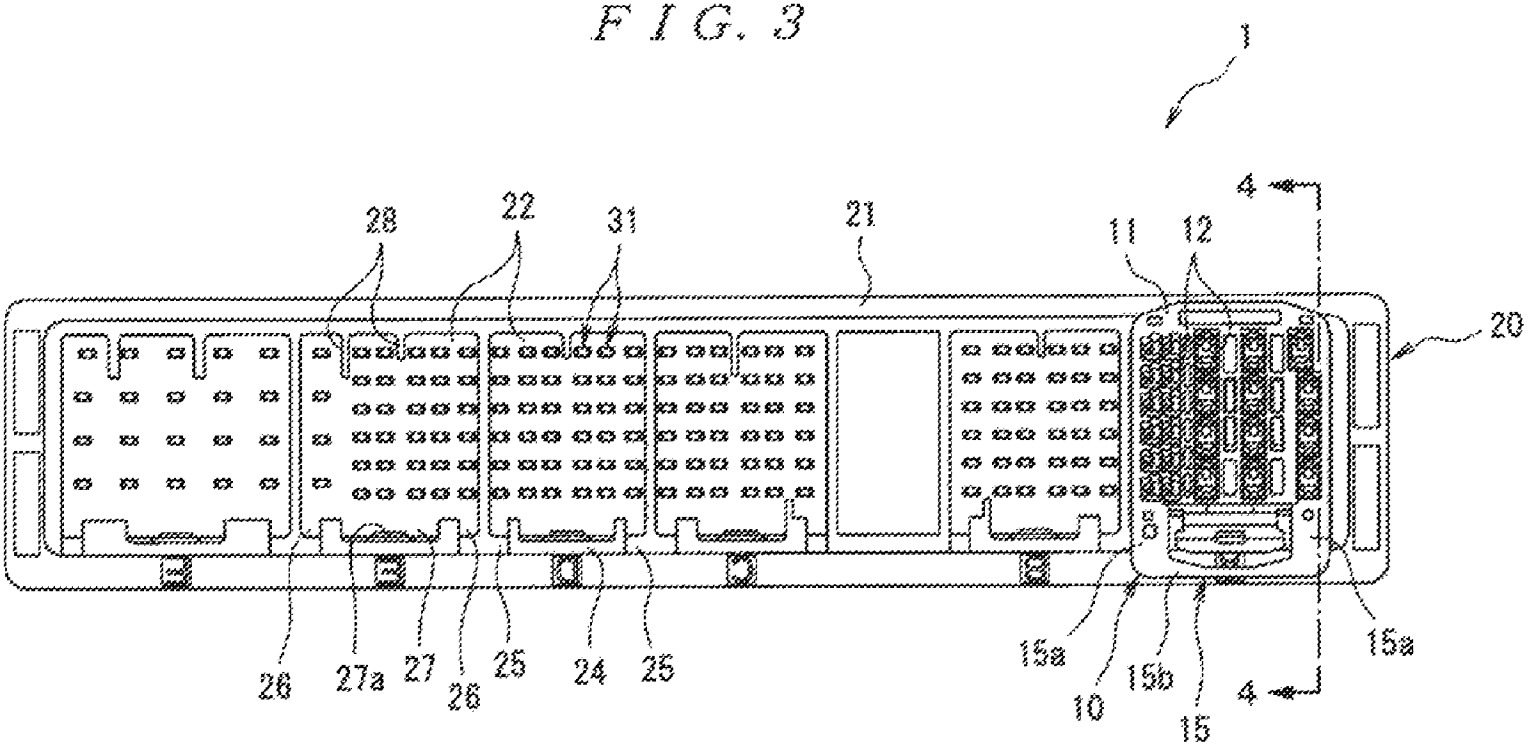
FIG. 3 is a front view of the electrical connector assembly of FIG. 1.
Figure 4:
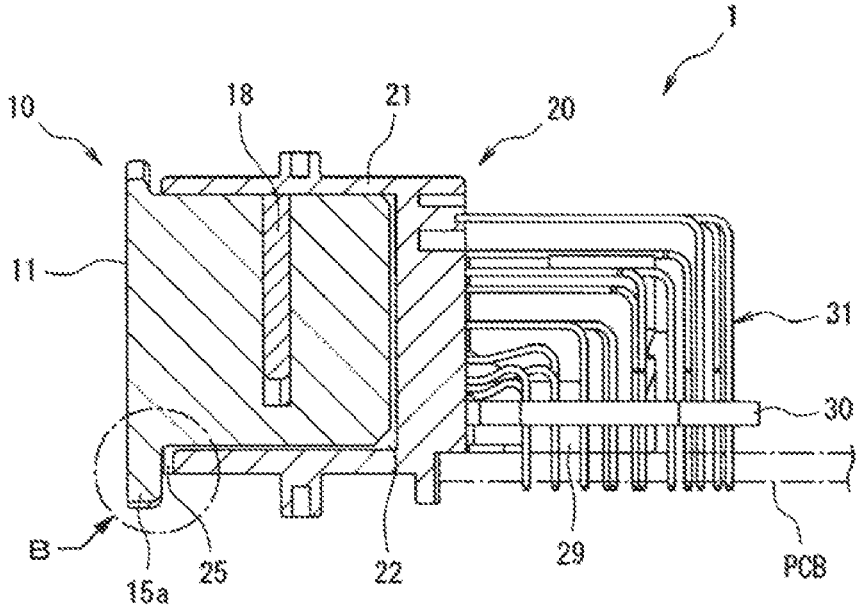
FIG. 4 is a sectional view along line 4-4 in FIG. 3; here, a circuit board is also indicated by a one-dot chain line in FIG. 4.
Figure 5:
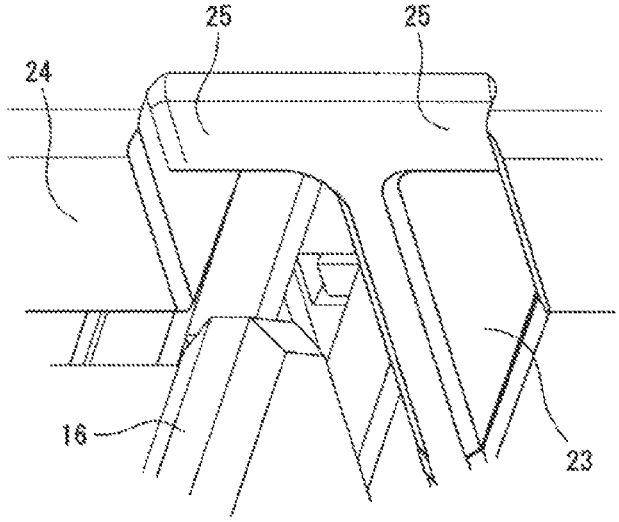
FIG. 5 is an enlarged view of the portion indicated by arrow A in FIG. 2.
Figure 6:
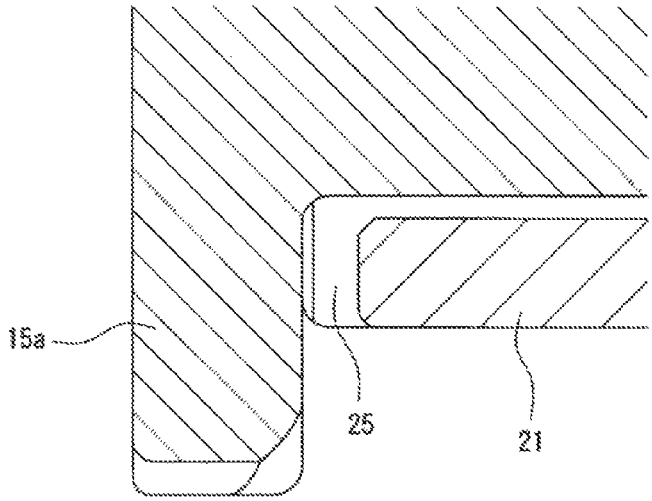
FIG. 6 is an enlarged view of the portion indicated by arrow B in FIG. 4.
Figure 7:
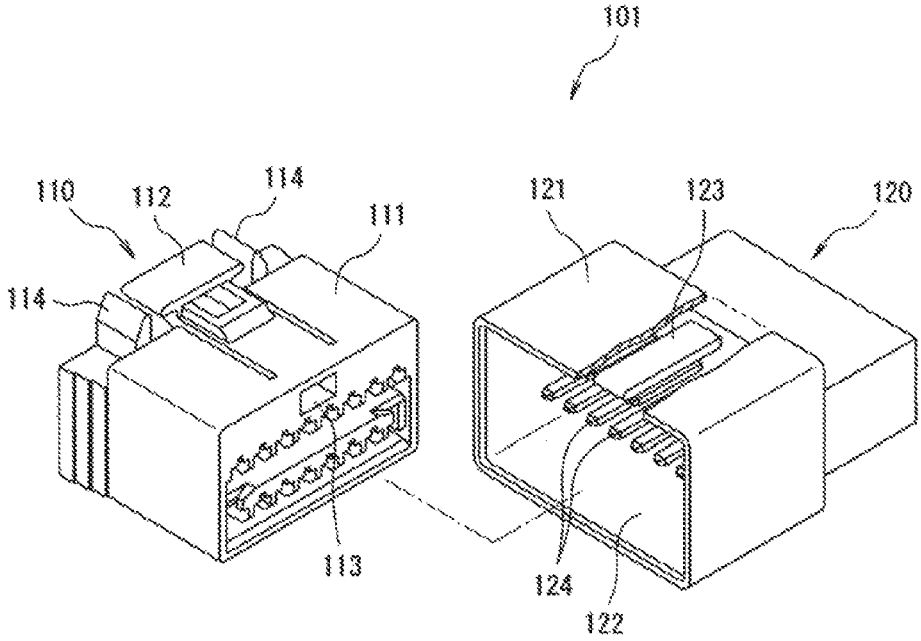
FIG. 7 is a perspective view showing a conventional example of an electrical connector prior to the mating of a pair of male and female connectors.

Next, an embodiment of the present invention will be described with reference to the figures. FIG. 1 is a perspective view of an electrical connector assembly of the present invention; here, only one male connector out of a plurality of male connectors that are caused to mate with a female connector is shown in FIG. 1. FIG. 2 is a perspective view of the electrical connector assembly of FIG. 1 as seen from the side of the undersurface. FIG. 3 is a front view of the electrical connector assembly of FIG. 1. FIG. 4 is a sectional view along line 4-4 in FIG. 3; here, a circuit board is also indicated by a one-dot chain line in FIG. 4. FIG. 5 is an enlarged view of the portion indicated by arrow A in FIG. 2. FIG. 6 is an enlarged view of the portion indicated by arrow B in FIG. 4.

In FIGS. 1 through 4, the electrical connector assembly 1 is constructed from a plurality of male connectors 10 (six male connectors in the present embodiment) and a single female connector 20 that mates with these male connectors 10. The reason that the plurality of male connectors 10 are thus designed to mate with the single female connector 20 is to reduce the mating force during the mating between these male connectors 10 and female connector 20.

Here, each of the male connectors 10 comprises a substantially rectangular male-type housing 11 and a plurality of female-type contacts (not shown in the figures) secured to the male-type housing 11 in a plurality of rows. The male-type housing 11 is formed by molding an insulating resin, and has female-type contact accommodating holes 12 formed in a plurality of rows. Furthermore, a cantilever-form lock arm 13 is provided on the undersurface (upper surface when viewed from the side of the undersurface in FIG. 2) of the male-type housing 11, with this lock arm 13 extending rearward from the front end (the end facing the female connector 20) and the free end thereof being positioned at the rear end of the housing. As is shown in FIG. 2, a locking projection 14 that protrudes downward is provided in the vicinity of the free end of this lock arm 13. Moreover, a lock arm protection member 15 that protrudes downward is provided at the rear end on the undersurface of the male-type housing 11 as shown in FIG. 2. The lock arm protection member 15 comprises a pair of leg parts 15*a*, 15*a* extending downward from either end of the male-type housing 11 in the direction of width and a linking part 15*b* that links between these leg parts 15*a*, 15*a* and that covers the vicinity of the free end of the lock arm 13. As a result of the lock arm protection member 15 being provided, it is possible to prevent the lock arm 13 from being damaged by an abrupt external force caused by electrical wires (not shown in the figures) being caught in the vicinity of the free end of the lock arm 13 during the assembly work of the male connector 10. In addition, a pair of projecting ribs 16 respectively extending from the leg parts 15*a*, 15*a* provided for the lock arm 13 to the front end of the male-type housing 11 are provided on the undersurface of the male-type housing 11 at either end in the direction of width as shown in FIG. 2. Meanwhile, a plurality of grooves 17 extending from the rear end to the front end of the male-type housing 11 are formed in the upper surface of the male-type housing 11 as shown in FIG. 1. Furthermore, in FIGS. 1 and 4, the symbol 18 is a retainer for performing the secondary locking of the female-type contacts attached to the male-type housing 11.

Moreover, the female connector 20 comprises a substantially rectangular female-type housing 21 extending in the direction of width (in the left-right direction in FIG. 1) and a plurality of male-type contacts 31 secured to the female-type housing 21 in a plurality of rows. The female-type housing 21 comprises a plurality of male connector receiving parts 22 (six receiving parts in the present embodiment) that receive the male-type housings 11 in a single row along the direction of width. Each of the male connector receiving parts 22 has a substantially rectangular cross-sectional shape corresponding to the external shape of the corresponding male-type housing 11, and opens on the front surface (the surface facing the male connector 10) of the female-type housing 21. In addition, adjacent male connector receiving parts 22 are partitioned by walls 23 that extend in the forward-rearward direction and vertical direction. As is shown in FIGS. 1, 2, and 5, all of the walls 23 partitioning adjacent male connector receiving parts 22 are such that the front ends thereof are positioned further toward the interior than a mating surface 24 which is the front surface of the male-type housing 11. Moreover, a lock arm receiving recessed part 27 that receives the lock arm 13 of the corresponding male connector 10 is formed in the lower wall of each male connector receiving part 22 so as to extend in the forward-rearward direction as shown in FIGS. 1, 2, and 3, and a locking part (lock member) 27*a* on which the locking projection 14 of the lock arm 13 latches is provided on this lock arm receiving recessed part 27 as shown in FIGS. 1 and 3. Furthermore, a pair of projecting rib receiving parts 26 that respectively receive the projecting ribs 16 of the corresponding male connector 10 extend in the forward-rearward direction at either end in the direction of width of the lower wall of each male connector receiving part 22. Moreover, as is shown in FIGS. 1 through 6, a pair of recessed parts 25 that respectively receive the pair of leg parts 15*a*, 15*a* of the lock arm protection member 15 on the corresponding male connector 10 are formed in the mating surface 24 in the lower wall of each male connector receiving part 22 out of the mating surface 24 of the female-type housing 21 to the front side of the projecting rib receiving recessed parts 26. The bottom surfaces of these recessed parts are coplanar with the walls 23 partitioning adjacent male connector receiving parts 22. In addition, as is shown in FIG. 1, a single or a plurality of projecting ribs 28 that are received in the plurality of grooves 17 formed in the upper surface of the corresponding male-type housing 11 extend in the forward-rearward direction on the upper wall of each male connector receiving part 22.

Furthermore, each of the male contacts 31 is designed such that one end protrudes into one of the male connector receiving parts 22 and contacts a female-type contact of the male connector 10, while the other end is bent downward at a right angle and connected to a circuit board PCB as shown in FIG. 4. Moreover, a pair of board mounting parts 29 that are mounted on the circuit board PCB are provided at either end in the direction of width of the rear surface of the female-type housing 21 so as to protrude rearward. A tine plate 30 for aligning the bent portions of the respective male-type contacts 31 is attached to these board mounting parts 29.

Next, the operation in cases where each of the male connectors 10 mates with the female connector 20 will be described.

When a specified male connector 10 is inserted into a specified male connector receiving part 22 of the female connector 20 as shown in FIGS. 1 and 2, the tip end of the male connector 10 contacts the end surface on the interior side of the male connector receiving part 22 of the female connector 20 as shown in FIGS. 3 and 4. At this point, the corresponding male-type contacts 31 of the female connector 20 are received by and make contact with the female-type contacts of the male connector 10. Furthermore, the lock arm 13 of the male connector 10 is received in the lock arm receiving recessed part 27, and the locking projection 14 of the lock arm 13 latches on the locking part 27*a*, so that the male connector 10 is prevented from slipping out. Moreover, during this mating, the projecting ribs 16 of the male connector 10 move inside the projecting rib receiving recessed parts 26 of the female connector 20, and the projecting rib(s) 28 of the female connector 20 are received in the grooves 17 in the male connector 10. Then, when the mating of the male connector 10 is completed, the pair of leg parts 15*a*, 15*a* of the lock arm protection member 15 of the male connector 10 are received in the pair of recessed parts 25 of the female connector 20 as shown in FIG. 6.

Here, if the male connector 10 is caused to mate with this male connector receiving part 22 of the female connector 20 in an inclined state during the mating of the male connector 10, the front end surface, one of the side surfaces, the upper surface, or the undersurface of the male-type housing 11 of the male connector 10 contacts the projecting rib(s) 28, wall 23, upper wall, or lower wall of the male connector receiving part 22, and this prevents the male-type contacts 31 of the male connector 10 from being twisted, thus avoiding the buckling of and damage to the male-type contacts 31.

In addition, as is clearly shown in FIG. 5, the front ends of the walls 23 between adjacent male connector receiving parts 22 of the female-type housing 21 of the female connector 20 are positioned further toward the interior than the mating surface 24 of the female-type housing 21. Therefore, the walls 23 between adjacent male connector receiving parts 22 are made to be shorter, so that it is possible to avoid the risk of breaking or damaging the walls 23 between adjacent male connector receiving parts 22 by the twisted mating of the male connectors 10 even if the mating depth is made smaller than in conventional products.

Moreover, the recessed parts 25, 25 that receive the leg parts 15*a*, 15*a* of the lock arm protection member 15 of the corresponding male connector 10 are formed in the mating surface 24 in the lower wall of each male connector receiving part 22 out of the mating surface 24 of the female-type housing 21. Therefore, the tip end positions of the male-type contacts 31 inside each male connector receiving part 22 can be refracted by the length for receiving the leg parts 15*a*, 15*a* of the lock arm protection member 15, so that it is possible to provide, with a simple construction, an electrical connector assembly which has no risk of damaging the male-type contacts 31 of the female connector 20 caused by the twisted mating of the male connector 10 even if the mating depth is made smaller than in conventional products. Furthermore, because the mating depth can be made smaller than in conventional products, it is possible to achieve a size reduction of the electrical connector assembly 1.

Furthermore, the recessed parts 25, 25 that receive the leg parts 15*a*, 15*a* of the lock arm protection member 15 of the corresponding male connector 10 are formed in the mating surface 24 in the lower wall of each male connector receiving part 22, so that there is no interference of the leg parts 15*a*, 15*a* of the lock arm protection member 15 with the mating surface 24 in the lower wall of each male connector receiving part 22.

In addition, when all of the male connectors 10 are inserted into all of the male connector receiving parts 22 in the female connector 20, the electrical connector assembly 1 is completed.

Note that when each of the male connectors 10 is to be pulled out of the corresponding male connector receiving part 22 of the female connector 20, it is only necessary to release the latching of the locking projection 14 on the locking part 27*a* by pushing the lock arm 13 upward from below and to pull the male connector 10 "as is."

An embodiment of the present invention has been described above. However, the present invention is not limited to this embodiment, and various alterations or modifications can be made.

For example, the lock arm 13 is provided on the undersurface of each male-type housing 11, but may also be provided on the upper surface of each male-type housing 11. In this case, the lock arm protection member 15 that protects the lock arm 13 is also formed so as to protrude upward from the upper surface of each male-type housing 11, and the recessed parts 25 that receive the lock arm protection member 15 are also formed in the mating surface 24 in the upper wall of each male connector receiving part 22 out of the mating surface 24 of the female-type housing 21.

The invention claimed is:

1. An electrical connector assembly comprising:

a plurality of male connectors, each of the male connectors comprises a male-type housing and a female-type contact secured to this male-type housing, each of the male-type housings has a lock arm that is provided on the upper surface or undersurface of the male-type housing with the free end of this lock arm being positioned at the rear end of the housing, and an arch-shaped lock arm protection member that protrudes upward or downward via a pair of leg parts from either side portion of the rear end of the upper surface or undersurface of the male-type housing and that covers the free end of the lock arm;

a female connector that mates with the plurality of male connectors, the female connector comprises a female-type housing and a male-type contact secured to this female-type housing, and the female-type housing has a plurality of male connector receiving parts that receive the male-type housings and lock members on which the lock arms respectively latch;

partition walls that divide mutually adjacent male connector receiving parts in the female-type housing such that the front ends thereof are positioned further toward the interior than the mating surface of the female-type housing; and a pair of recessed parts that receive the pair of leg parts of the lock arm protection member of each of the male connectors are located in the mating surface in the upper wall or lower wall of each of the male connector receiving parts.

2. The electrical connector assembly according to claim 1, wherein the bottom surfaces of the recessed parts of the female-type housing that respectively receive the leg parts of the lock arm protection members are coplanar with the front ends of the partition walls that divide mutually adjacent male connector receiving parts.

3. The electrical connector assembly according to claim 2, wherein the female-type housing has three or more of the male connector receiving parts that are separated from each other by the partition walls.

4. The electrical connector assembly according to claim 3, wherein the thickness of the partition walls that divide mutually adjacent male connector receiving parts in the female-type housing is smaller than the thickness of the outer walls of the female-type housing.

* * * * *